US010238225B2

(12) United States Patent
Asher

(10) Patent No.: US 10,238,225 B2
(45) Date of Patent: Mar. 26, 2019

(54) COMPRESSION GARMENT DONNING AID DEVICE, METHOD, AND KIT

(71) Applicant: Dorothy Asher, Elmhurst, IL (US)

(72) Inventor: Dorothy Asher, Elmhurst, IL (US)

(73) Assignee: Windor Enterprises, LLC, Elmhurst, IL (US)

( * ) Notice: Subject to any disclaimer, the term of this patent is extended or adjusted under 35 U.S.C. 154(b) by 262 days.

(21) Appl. No.: 15/176,770

(22) Filed: Jun. 8, 2016

(65) Prior Publication Data

US 2017/0354283 A1 Dec. 14, 2017

(51) Int. Cl.
*A47G 25/90* (2006.01)

(52) U.S. Cl.
CPC ..... *A47G 25/90* (2013.01)

(58) Field of Classification Search
CPC ..... A47G 25/90; A47G 25/905; A47G 25/907
USPC ..... 223/111, 112
See application file for complete search history.

(56) References Cited

U.S. PATENT DOCUMENTS 5,673,826 A * 10/1997 Stolk ..... A47G 25/907 223/111
6,032,839 A 3/2000 Joosten et al.
6,886,185 B2 5/2005 Wren
7,699,195 B2 4/2010 Scott
8,042,716 B2 10/2011 Lun
8,511,523 B2 8/2013 Joosten et al.
2004/0178234 A1* 9/2004 Sawlewicz ..... A47G 25/907 223/111
2009/0242594 A1* 10/2009 Van Den Berge ... A47G 25/907 223/111
2010/0270341 A1 10/2010 Joosten
2010/0292622 A1* 11/2010 Weissleder ..... A61F 5/0193 602/23

* cited by examiner

*Primary Examiner* — Nathan Durham
(74) *Attorney, Agent, or Firm* — Cardinal Law Group

(57) ABSTRACT

Compression garment donning aid devices, methods, and kits including a compression garment donning aid with flexible sheets, each of the flexible sheets having: a sheet leg edge having a first sheet leg corner opposite a second sheet leg corner; a mateable sheet leg fastener attached to the first sheet leg corner and the second sheet leg corner; and a sheet waist edge opposite the sheet leg edge, the sheet waist edge having a front sheet waist corner opposite a back sheet waist corner. The donning aid further includes a sheet back fastener attached to the back sheet waist corner of one of the flexible sheets and the back sheet waist corner of the other of the flexible sheets; and a sheet front fastener attached to the front sheet waist corner of one of the flexible sheets and the front sheet waist corner of the other of the flexible sheets.

16 Claims, 10 Drawing Sheets

COMPRESSION GARMENT DONNING AID DEVICE, METHOD, AND KIT

TECHNICAL FIELD

The technical field of this disclosure is clothing donning aids, particularly, compression garment donning aid devices, methods, and kits.

BACKGROUND OF THE INVENTION

Compression garments, which provide a compressive force on the wearer, have been developed for a number of purposes such as therapeutic and athletic wear.

Therapeutic uses include post-surgical use to promote incision healing, reduce bruising and swelling, and hold the surgical area firmly in place. Therapeutic uses can also include support of veins and increased circulation in extremities for vascular disorders, edema, lymphatic edema, lymphedema, or spider veins.

Athletic uses include performance swimwear, technical swimsuits, triathlon suits, and compression workout wear. Such uses can enhance the athlete's performance and aid in recovery after a strenuous workout or competition. Technical swimsuits enhance performance to the extent that they are required for competitive swimming, in spite of the cost of several hundred dollars.

Unfortunately, each of these uses has its problems. For therapeutic uses, the user may have limited flexibility or mobility which impedes or prevents them from putting on the compression garments. For athletic uses, particularly technical swimsuits, the compression garments are both delicate and difficult to put on. The swimmer and the swimsuit should be dry, gloves should be worn to avoid snagging the swimsuit, and fingernails must be trimmed and smooth if gloves are not used. Even when handled properly, the swimwear may be ripped or torn when being put on. The technical swimsuits are expensive and only good for a few swims (about 4 to 8). Further, the technical swimsuits are difficult to put on because of the compression which resists sliding the swimsuit over the body, particularly when the body is wet or damp. Most swimmers require 45 minutes to an hour to get the swimsuits on. The Fédération Internationale de Natation (FINA), which governs international competition in aquatic sports, also prohibits zippers or other fastening systems in swimwear, leaving no choice but to slide the swimsuit over the body when putting it on. For swim meets, the swimmer warms up in a regular swimsuit and then changes to the technical swimsuit for the race. The swimmer is wet or damp when changing from the regular swimsuit, making it especially hard to slip on the technical swimsuit. This increases the mental and physical stress associated with putting on the technical swimsuit before the race.

It would be desirable to have compression garment donning aid devices, methods, and kits that would overcome the above disadvantages.

SUMMARY OF THE INVENTION

One aspect of the invention provides a compression garment donning aid to assist a user with a compression garment, the compression garment donning aid including a pair of flexible sheets, each of the pair of flexible sheets having: a sheet leg edge having a first sheet leg corner opposite a second sheet leg corner; a mateable sheet leg fastener attached to the first sheet leg corner and the second sheet leg corner; and a sheet waist edge opposite the sheet leg edge, the sheet waist edge having a front sheet waist corner opposite a back sheet waist corner. The compression garment donning aid further includes a sheet back fastener attached to the back sheet waist corner of one of the pair of flexible sheets and the back sheet waist corner of the other of the pair of flexible sheets; and a sheet front fastener attached to the front sheet waist corner of one of the pair of flexible sheets and the front sheet waist corner of the other of the pair of flexible sheets. At least one of the sheet back fastener and the sheet front fastener is openable.

Another aspect of the invention provides a method for a user to don a compression garment, the user having a user waist and a pair of user legs, the compression garment having a garment waist and garment leg hems, the method including: securing sheet waist edges of a pair of flexible sheets around the user waist, each of the pair of flexible sheets having a sheet leg edge and the sheet waist edge opposite the sheet leg edge; securing the sheet leg edge of one of the pair of flexible sheets around one of the user legs and the sheet leg edge of the other of the pair of flexible sheets around the other of the user legs; sliding the compression garment onto the user over the pair of flexible sheets with the secured sheet waist edges accessible at the garment waist and with the secured sheet leg edges exposed below the garment leg hems; releasing the secured sheet leg edges from around the user legs; releasing the secured sheet waist edges from around the user waist; and pulling the pair of flexible sheets from between the compression garment and the user through the garment waist.

Another aspect of the invention provides compression garment kit for a user having, the kit including: a compression garment; and a compression garment donning aid. The compression garment donning aid includes a pair of flexible sheets, each of the pair of flexible sheets having: a sheet leg edge having a first sheet leg corner opposite a second sheet leg corner; a mateable sheet leg fastener attached to the first sheet leg corner and the second sheet leg corner; and a sheet waist edge opposite the sheet leg edge, the sheet waist edge having a front sheet waist corner opposite a back sheet waist corner. The compression garment donning aid further includes a sheet back fastener attached to the back sheet waist corner of one of the pair of flexible sheets and the back sheet waist corner of the other of the pair of flexible sheets; and a sheet front fastener attached to the front sheet waist corner of one of the pair of flexible sheets and the front sheet waist corner of the other of the pair of flexible sheets. At least one of the sheet back fastener and the sheet front fastener is openable.

The foregoing and other features and advantages of the invention will become further apparent from the following detailed description of the presently preferred embodiments, read in conjunction with the accompanying drawings. The detailed description and drawings are merely illustrative of the invention, rather than limiting the scope of the invention being defined by the appended claims and equivalents thereof.

DETAILED DESCRIPTION

Figure 1:
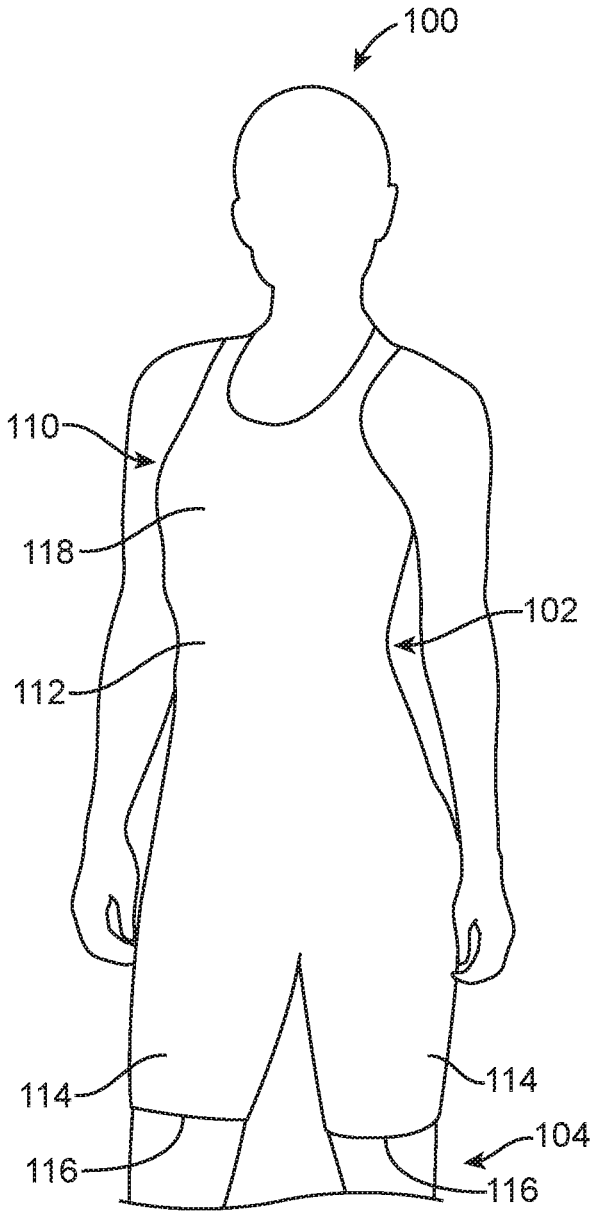
FIG. 1 is a schematic diagram of a compression garment for use with a compression garment donning aid in accordance with the invention.

FIG. 1 is a schematic diagram of a compression garment for use with a compression garment donning aid in accordance with the invention. The compression garment can also be part of a compression garment kit.

The user 100 has a user waist 102 and a pair of user legs 104. The compression garment 110 includes a garment waist 112 and garment legs 114 with a pair of garment leg hems 116. In this example, the compression garment 110 also includes a garment top 118. Those skilled in the art will appreciate that the compression garment 110 can be selected as desired for a particular application. In another example, the compression garment can be a jammer swimming trunk with the garment top omitted, such as commonly used by men. In another example, the compression garment can include partial or full sleeves and/or full legs, such as commonly used in open water or triathlon swimming events.

As defined herein, the compression garment can be any garment covering the user from at least waist sub-navel to mid-thigh and made of elastic material which compresses the user when worn. The compression garment can be for athletic or therapeutic use. Those skilled in the art will appreciate that the amount of compression depends on the particular use of the compression garment, but is typically in the range of 5 to 40 mmHg. The elastic material can be a textile fabric consisting of natural and/or synthetic individual and non-consolidated yarns use to constitute a fabric by weaving, knitting, and/or braiding, or a non-textile fabric consisting of polyurethane, neoprene, rubber, latex, silicone, or the like. Exemplary compression garments for athletic use include the LZR Racer X Kneeskin available from Speedo USA of Cypress, Calif.; the Women's Avictor Swimsuit available from TYR Sport, Inc., of Seal Beach, Calif.; the POWERSKIN Carbon available from Arena North America, LLC, of Portland, Oreg.; the Nike NG-1 available from Nike, Inc., of Beaverton, Oreg.; and Blueseventy NERO TX from blueseventy USA, of Seattle, Wash. Fédération Internationale de Natation (FINA), which governs international competition in aquatic sports, provides a list of approved swimwear including compression garments at http://www.fina.org/content/fina-approved-swimwear. Exemplary compression garments for therapeutic use are available from a number of suppliers, such as Medico International, Inc., of Palmer, Pa., having a website at http://www.medicointernational.com. The compression garment can also be part of a compression garment kit including the compression garment and a compression garment donning aid.

Figure 2A:
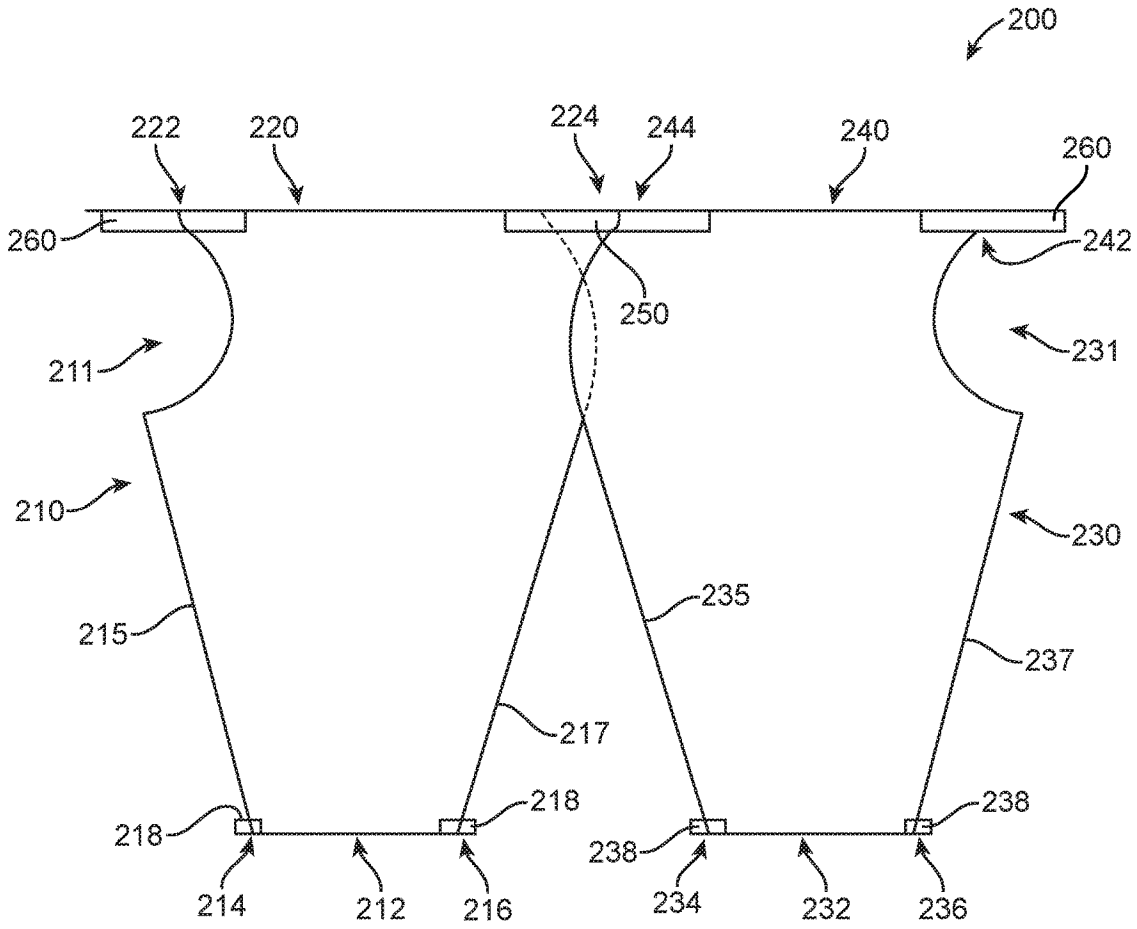
FIGS. 2A-2C are schematic diagrams of a compression garment donning aid in accordance with the invention.
Figure 2C:
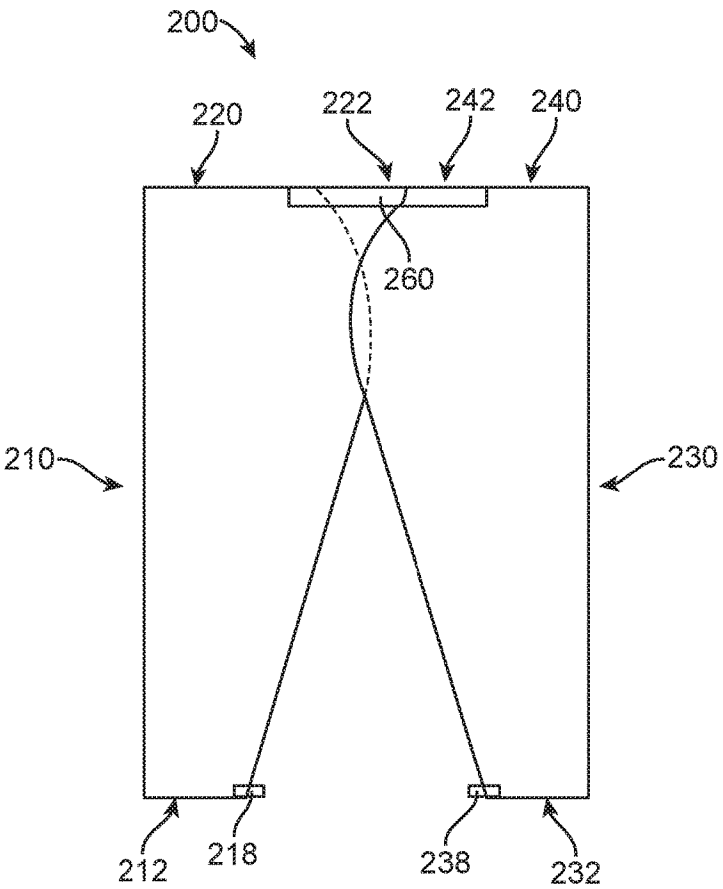
Figure 2B:
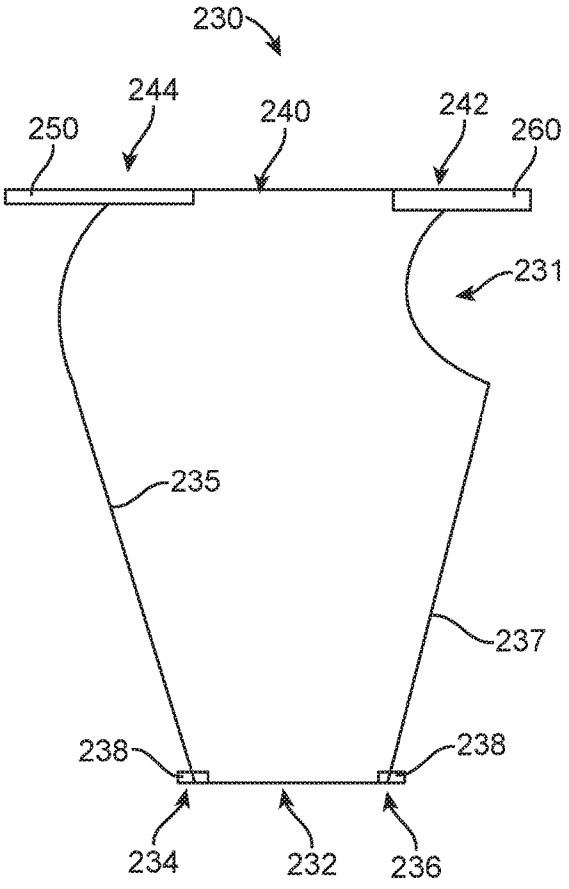

FIGS. 2A-2C, in which like elements share like reference numbers, are schematic diagrams of a compression garment donning aid in accordance with the invention. FIGS. 2A-2C illustrate a compression garment donning aid, one flexible sheet of a compression garment donning aid, and a deployed compression garment donning aid, respectively.

Referring to FIG. 2A, the compression garment donning aid 200 is to assist a user with a compression garment (not shown) having a garment waist and a pair of garment leg hems. The compression garment donning aid 200 includes a pair of flexible sheets 210, 230. The flexible sheet 210 has a sheet leg edge 212 having a first sheet leg corner 214 opposite a second sheet leg corner 216; a mateable sheet leg fastener 218 attached to the first sheet leg corner 214 and the second sheet leg corner 216; and a sheet waist edge 220 opposite the sheet leg edge 212, the sheet waist edge 220 having a front sheet waist corner 222 opposite a back sheet waist corner 224. The flexible sheet 210 has a front edge 215 between the front sheet waist corner 222 and the first sheet leg corner 214, and a back edge 217 between the back sheet waist corner 224 and the second sheet leg corner 216. In this example, the front edge 215 defines a fabric cut out 211, which can be used to reduce the bulk of fabric at the user waist. Those skilled in the art will appreciate that the shape of the fabric cut out can be any shape desired for a particular application, can be omitted, can be included on the back edge.

The flexible sheet 230 has a sheet leg edge 232 having a first sheet leg corner 234 opposite a second sheet leg corner 236; a mateable sheet leg fastener 238 attached to the first sheet leg corner 234 and the second sheet leg corner 236; and a sheet waist edge 240 opposite the sheet leg edge 232, the sheet waist edge 240 having a front sheet waist corner 242 opposite a back sheet waist corner 244. The flexible sheet 230 has a front edge 237 between the front sheet waist corner 242 and the second sheet leg corner 236, and a back edge 235 between the back sheet waist corner 244 and the first sheet leg corner 234. In this example, the front edge 237 defines a fabric cut out 231, which reduces the bulk of fabric at the user waist. Those skilled in the art will appreciate that the shape of the fabric cut out can be any shape desired for a particular application, can be omitted, can be included on the back edge.

The compression garment donning aid 200 further includes a sheet back fastener 250 attached to the back sheet waist corner 224 of the flexible sheet 210 and the back sheet waist corner 244 of the flexible sheet 230; and a sheet front fastener 260 attached to the front sheet waist corner 222 of the flexible sheet 210 and the front sheet waist corner 242 of the flexible sheet 230. At least one of the sheet back fastener 250 and the sheet front fastener 260 is openable.

FIG. 2B illustrates one flexible sheet 230 of the compression garment donning aid 200. The sheet back fastener 250 is open so that only the portion attached to the back sheet waist corner 244 is present.

FIG. 2C illustrates the deployed compression garment donning aid 200 with each of the flexible sheets folded so the front edge is aligned with the back edge. The mateable sheet leg fastener 218 is closed so that the sheet leg edge 212 can encircle one leg and the mateable sheet leg fastener 238 is closed so that the sheet leg edge 232 can encircle the other leg. The sheet front fastener 260 is closed to attach the front sheet waist corner 222 to the front sheet waist corner 242. The sheet back fastener (not shown) is also closed to attach the back sheet waist corner (not shown) and the back sheet waist corner (not shown). The sheet waist edge 220 and the sheet waist edge 240 form a circle to be secured around the user waist.

Those skilled in the art will appreciate that the flexible sheets 210, 230 of the compression garment donning aid 200 can be sized as desired for a particular application. In one embodiment, the compression garment (not shown) has a garment waist and garment leg hems, and the length of each of the flexible sheets 210, 230 between the sheet waist edge 220, 240 and the sheet leg edge 212, 232 is so dimensioned as to be greater than the length between the garment waist and the garment leg hems. In one embodiment, the length between the first sheet leg corner 214, 234 and the second sheet leg corner 216, 236 of each of the flexible sheets 210, 230 is so dimensioned as to reach around the lower leg of the user. In one embodiment, the length of each of the sheet waist edges 220, 240 of the flexible sheets 210, 230 is so dimensioned as to reach around a waist of the user.

Those skilled in the art will appreciate that the flexible sheets 210, 230 can be made of any material which allows the flexible sheets to be pulled from between the compression garment and the user, regardless of whether the user is dry, damp, or wet. The material can be a textile or non-textile fabric. In one embodiment, the material can be slippery to ease removal when pulling the pair of flexible sheets from between the compression garment and the user through the garment waist. In one embodiment, the material can be coated on one or both sides with friction reducing coating, such as silicone, polytetrafluoroethylene (PTFE), or the like. In one example, the flexible sheets 210, 230 are made of ripstop nylon or ripstop polyester.

The seams of the flexible sheets 210, 230 can be finished or unfinished as desired for a particular application. In one embodiment, the seams at the edges of the flexible sheets can be folded over and sewn to prevent fraying of the fabric. In another embodiment, the seams at the edges of the flexible sheets can be heat welded.

The fasteners, such as the mateable sheet leg fasteners 218, 238, the sheet back fastener 250, and the sheet front fastener 260, can be any type of fastener desired for a particular application. The mateable sheet leg fasteners 218, 238 can be any type of fastener that will not damage the compression garment when the flexible sheets are pulled from under the compression garment. Exemplary fasteners include hook and loop fasteners (such as Velcro® brand fasteners), fabric or string ties, snaps, buttons, magnets, zippers, buckles, elastic, or the like. In one embodiment, the fasteners can be adjustable to fit various user waist and user leg sizes. As defined herein, a fastener is openable when the fastener is either separable or elastic, allowing the corners to which the fastener is attached to be moved apart. When the fastener is separable, the fastener includes mateable parts which can be disconnected and the corners to which the fastener is attached can be disconnected and separated. When the fastener is elastic, the elastic can be stretched and the corners to which the fastener is attached can be pulled away from each other. In one example, the mateable sheet leg fasteners 218, 238, the sheet back fastener 250, and the sheet front fastener 260 can be hook and loop fasteners.

The mateable sheet leg fasteners 218, 238 are separable to allow release of the secured sheet leg edges 212, 232 from around the user legs so that the flexible sheets can be pulled upwardly along the user legs from between the compression garment and the user through the garment waist, e.g., the mateable sheet leg fastener 218, 238 of each of the flexible sheets 210, 230 can be a hook and loop fastener. In one example, one or both of the sheet back fastener 250 and the sheet front fastener 260 are separable to allow release of the secured sheet waist edges from around the user waist, e.g., at least one of the sheet back fastener 250 and the sheet front fastener 260 can be a hook and loop fastener. In another example, one of the sheet back fastener 250 and the sheet front fastener 260 can be a fixed connection when the other of the sheet back fastener 250 and the sheet front fastener 260 is separable, e.g., one of the sheet back fastener 250 and the sheet front fastener 260 can be a fixed connection between the flexible sheets 210, 230. The fixed connection permanently attaches the sheet waist corner of one of the flexible sheets to the sheet waist corner of the other of the flexible sheets, while the other fastener is separable. In yet another example, one or both of the sheet back fastener 250 and the sheet front fastener 260 are elastic, e.g., at least one of the sheet back fastener 250 and the sheet front fastener 260 is elastic, allowing the compression garment donning aid to be pulled over the torso and head of the user after the compression garment donning aid has been pulled from between the compression garment and the user through the garment waist.

FIGS. 3A-3F, in which like elements share like reference numbers, are schematic diagrams illustrating a method for a user to don a compression garment in accordance with the invention. An exemplary compression garment is described in conjunction with FIG. 1 and an exemplary compression garment donning aid is described in conjunction with FIGS. 2A-2C. The combination of a compression garment and a compression garment donning aid as described in conjunction with FIG. 1 and FIGS. 2A-2C forms a compression garment kit.

Figure 3A:
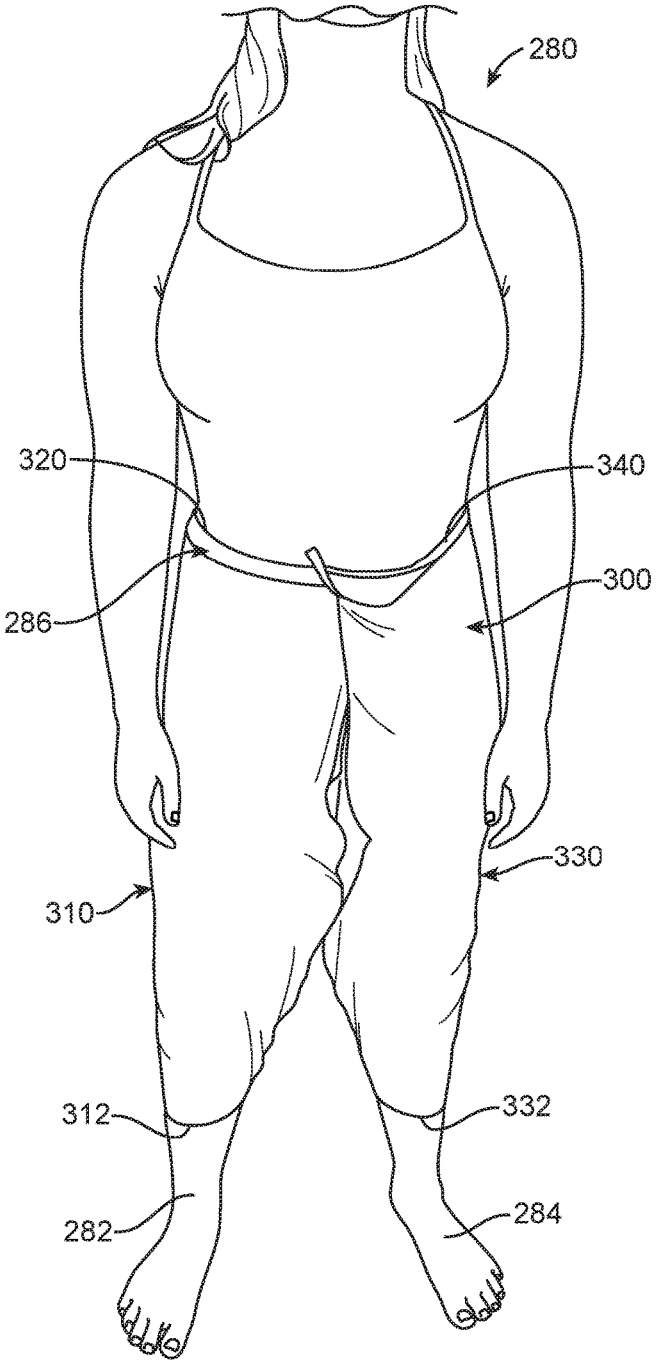
FIGS. 3A-3F are schematic diagrams illustrating a method for a user to don a compression garment in accordance with the invention.

Referring to FIG. 3A, a user 280 is illustrated wearing a compression garment donning aid 300. Sheet waist edge 320 of flexible sheet 310 and sheet waist edge 340 of flexible sheet 330 is secured around user waist 286 of the user 280. Each of the pair of flexible sheets 310, 330 has a sheet leg edge 312, 332 opposite the sheet waist edge 320, 340. The sheet leg edge 312 of flexible sheet 310 is secured around leg 282 of the user 280 and the sheet leg edge 332 of flexible sheet 330 is secured around leg 284 of the user 280. In this example, the user 280 is shown wearing a swimsuit under the compression garment donning aid 300, but typically either no or minimal undergarments will be used with the compression garment donning aid 300 so that the compression garment donning aid 300 will be in contact with the skin of the user 280.

Figure 3B:
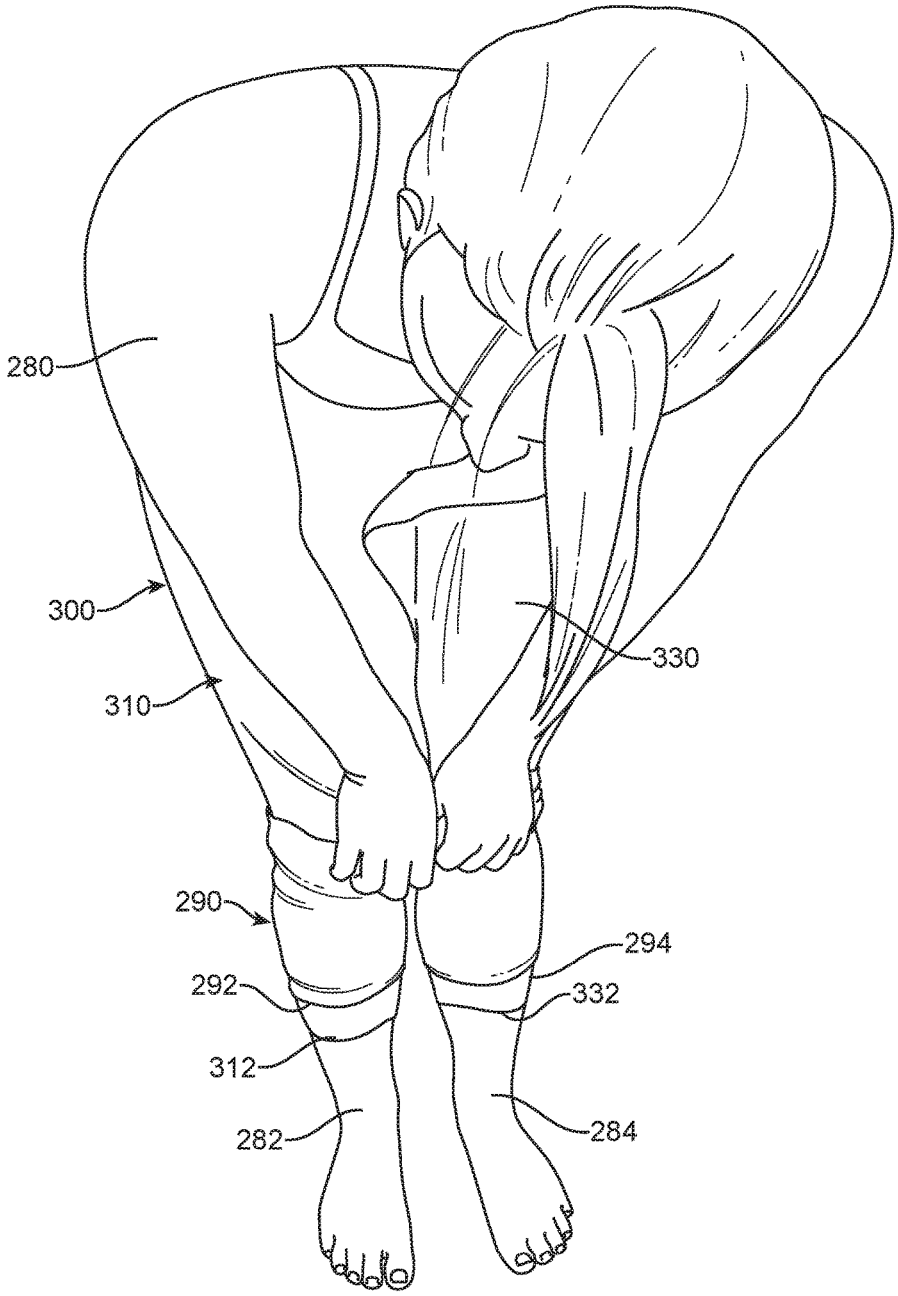

Referring to FIG. 3B, the user 280 is illustrated sliding a compression garment 290, in this example a swimsuit, over the pair of flexible sheets 310, 330 of the compression garment donning aid 300. The secured sheet leg edges 312, 332 are exposed below the garment leg hems 292, 294 so that the secured sheet leg edges 312, 332 can be released from around the user legs 282, 284 after the compression garment 290 is in place.

Figure 3C:
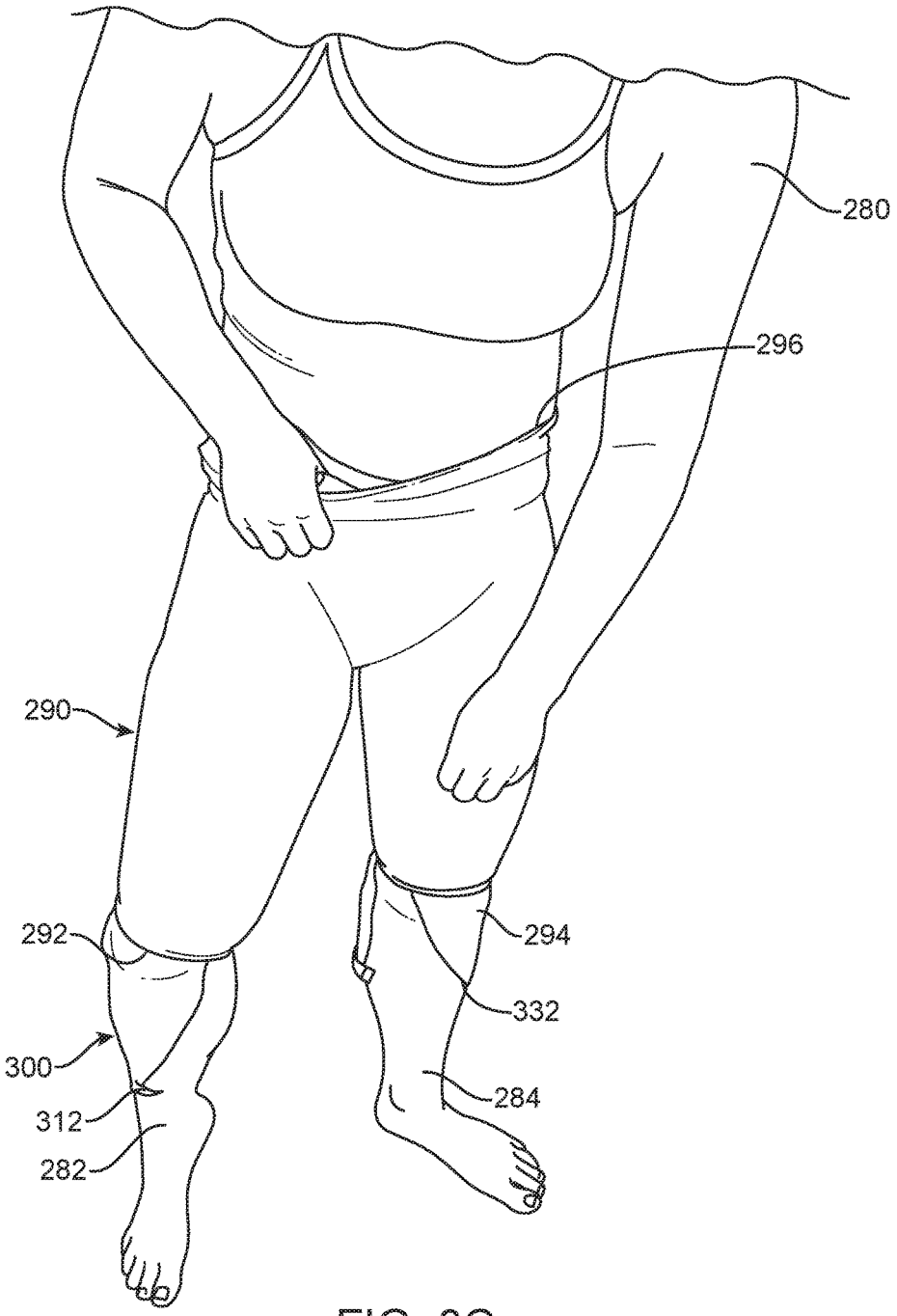

Referring to FIG. 3C, the user 280 is illustrated with the compression garment 290 in place over the flexible sheets 310, 330 of the compression garment donning aid 300. The secured sheet waist edges (not shown) of the flexible sheets 310, 330 are accessible at the garment waist 296 of the compression garment 290 so that the flexible sheets 310, 330 can be pulled from between the compression garment 290 and the user 280 through the garment waist 296. The secured sheet leg edges 312, 332, which have been released from around the user legs 282, 284 by opening the mateable sheet leg fasteners (not shown), are exposed below the garment leg hems 292, 294.

Figure 3D:
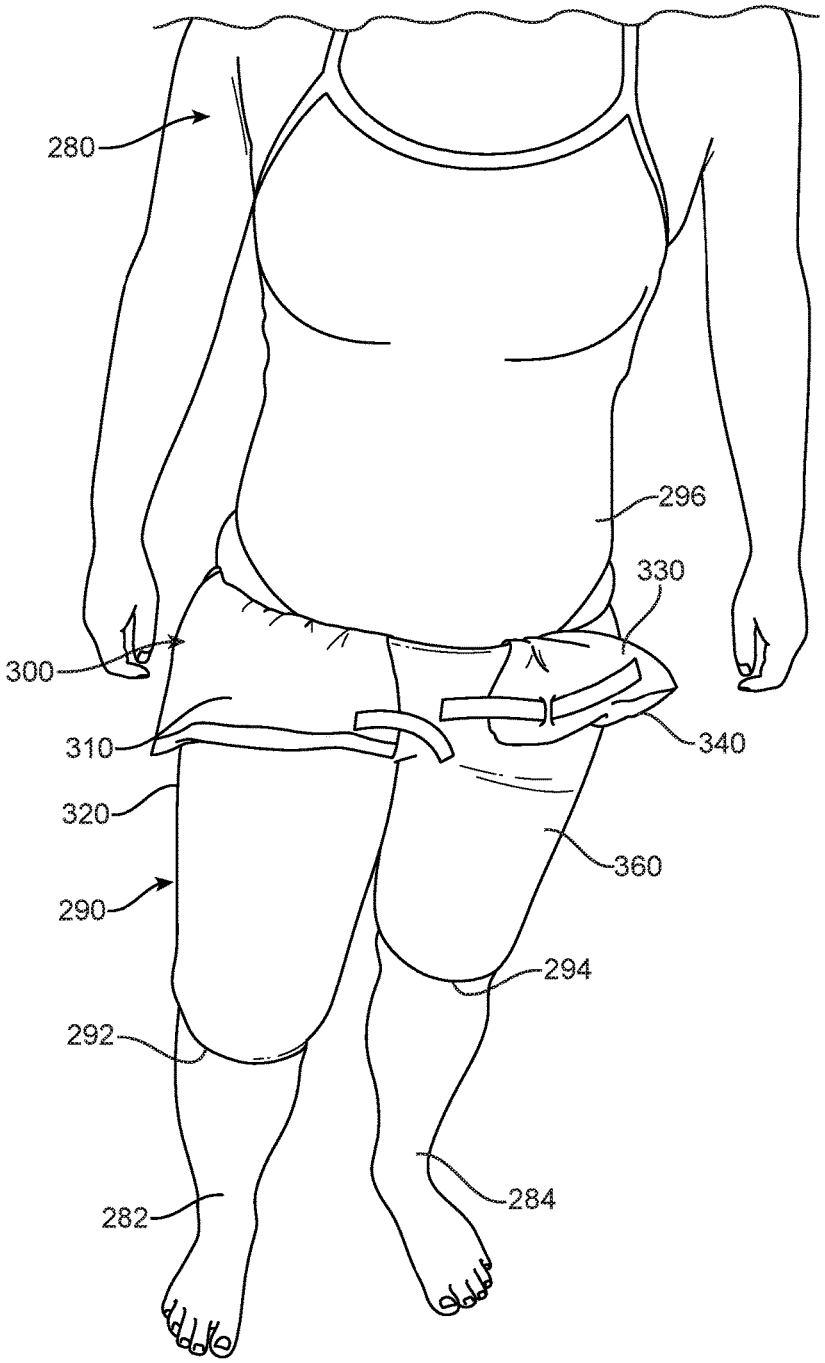

Referring to FIG. 3D, the user 280 is illustrated with the flexible sheets 310, 330 partially pulled from between the compression garment 290 and the user 280 through the garment waist 296. The secured sheet waist edges 320, 340 of the flexible sheets 310, 330 have been released by opening one or both of the sheet back fastener (not shown) and the sheet front fastener 360. The secured sheet leg edges (not shown) have been pulled upward through the garment leg hems 292, 294.

Figure 3E:
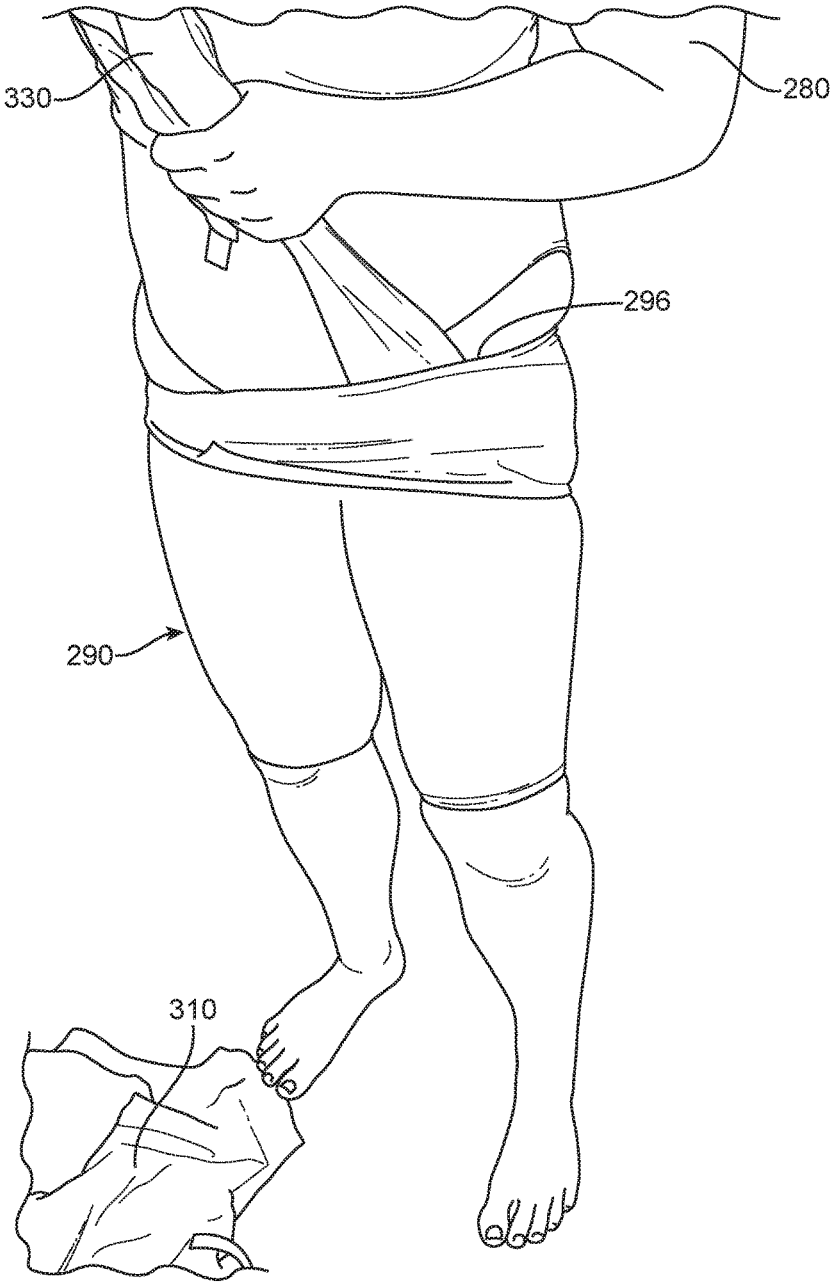

Referring to FIG. 3E, the user 280 is illustrated with the flexible sheet 310 completely removed and the flexible sheet 330 pulled further from between the compression garment 290 and the user 280 through the garment waist 296.

Figure 3F:
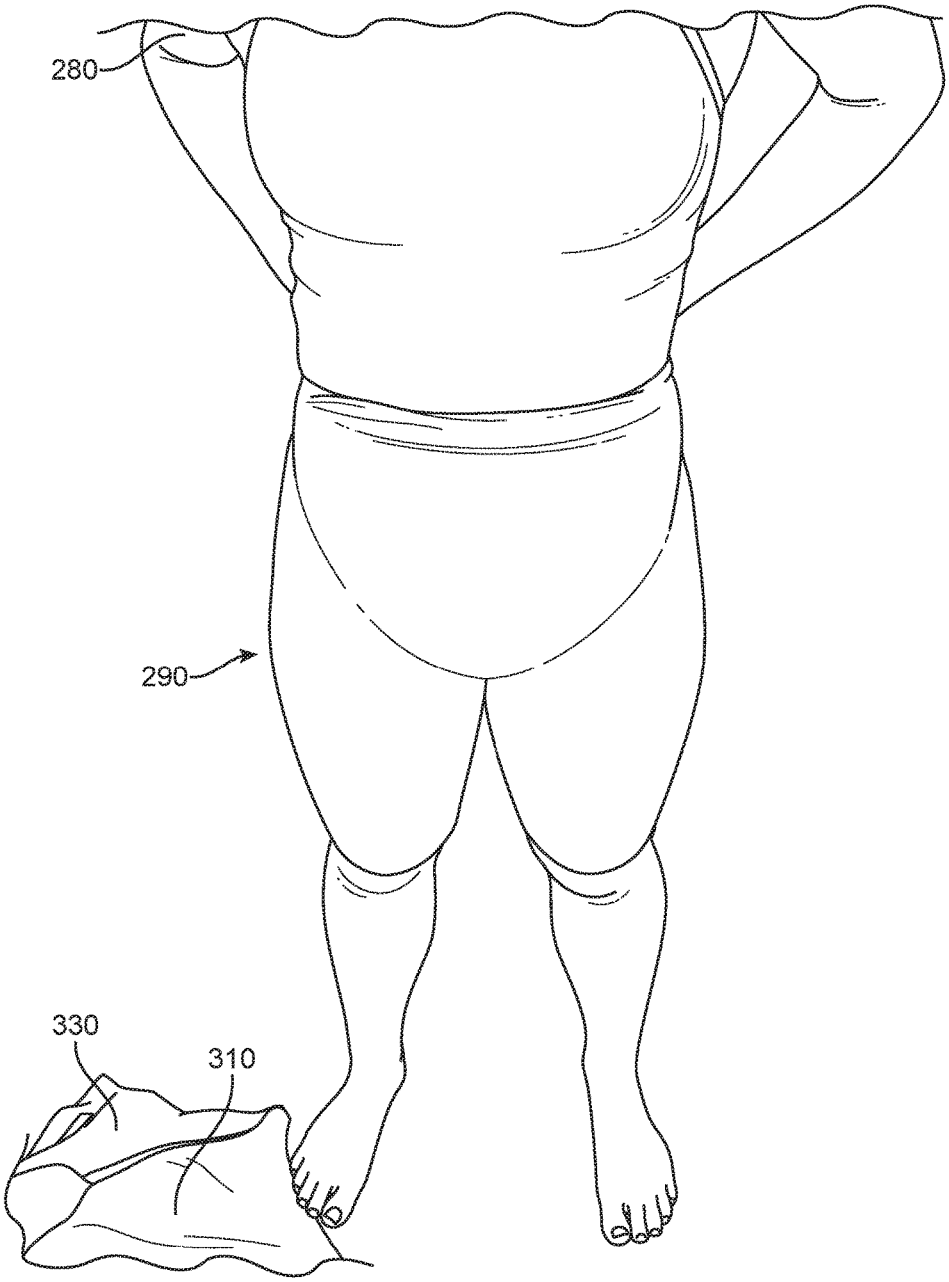

Referring to FIG. 3F, the user 280 is illustrated with the flexible sheets 310, 330 completely removed and the compression garment 290 in place. When the compression garment 290 includes a garment top, the user 280 can now work the garment top into place around their upper body.

Figure 4:
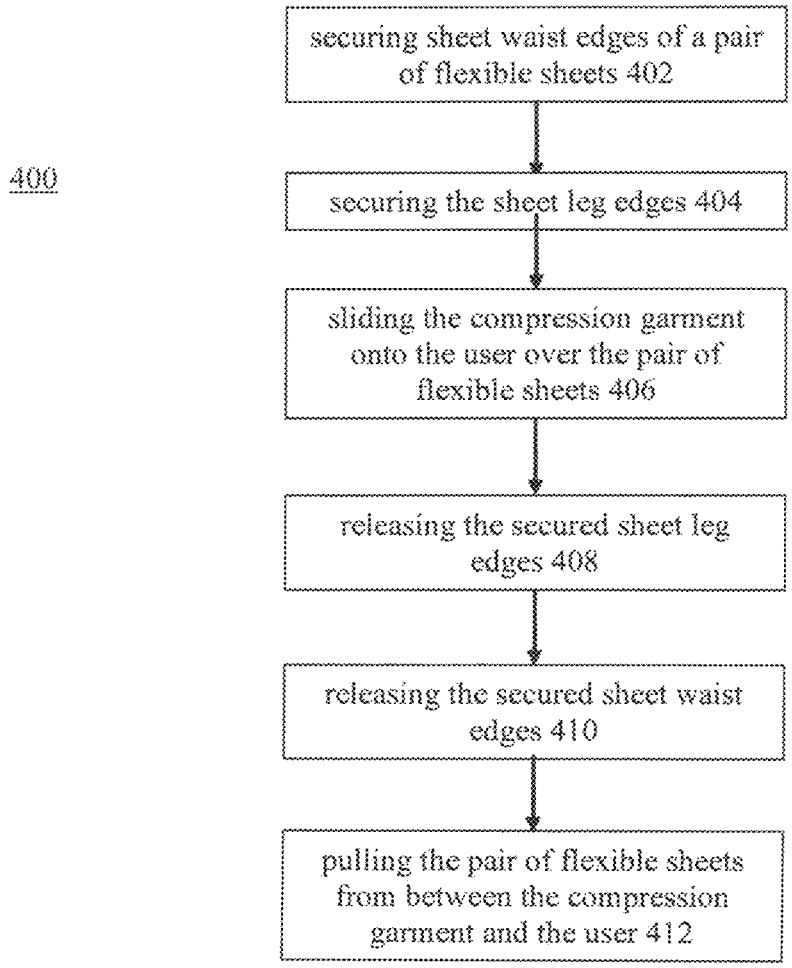
FIG. 4 is a flow chart of a method for a user to don a compression garment in accordance with the invention.

FIG. 4 is a flow chart of a method for a user to don a compression garment in accordance with the invention. The method 400 uses a compression garment donning aid as described in conjunction with FIGS. 2A-2C and performed in the example of FIGS. 3A-3F.

Referring to FIG. 4, the method 400 is for a user to don a compression garment, the user having a user waist and a pair of user legs, and the compression garment having a garment waist and garment leg hems. The method 400 includes: securing sheet waist edges of a pair of flexible sheets 402 around the user waist, each of the pair of flexible sheets having a sheet leg edge and the sheet waist edge opposite the sheet leg edge; securing the sheet leg edge of one of the pair of flexible sheets around one of the user legs and the sheet leg edge of the other of the pair of flexible sheets around the other of the user legs 404; sliding the compression garment onto the user over the pair of flexible sheets 406 with the secured sheet waist edges accessible at the garment waist and with the secured sheet leg edges exposed below the garment leg hems; releasing the secured sheet leg edges 408 from around the user legs; releasing the secured sheet waist edges 410 from around the user waist; and pulling the pair of flexible sheets from between the compression garment and the user 412 through the garment waist.

Those skilled in the art will appreciate that the method 400 can be adapted as desired for a particular application. In one example, when the user has an upper body and the compression garment has a garment top, the method 400 can include working the garment top around the upper body after the pulling 412. In another example, the securing sheet waist edges of a pair of flexible sheets 402 can include securing sheet waist edges of a pair of flexible sheets around the user waist with at least one hook and loop fastener. In yet another example, the securing the sheet leg edge 404 can include securing each of the sheet leg edges around each of the user legs with a hook and loop fastener.

It is important to note that FIGS. 1-4 illustrate specific applications and embodiments of the invention, and are not intended to limit the scope of the present disclosure or claims to that which is presented therein. Upon reading the specification and reviewing the drawings hereof, it will become immediately obvious to those skilled in the art that myriad other embodiments of the invention are possible, and that such embodiments are contemplated and fall within the scope of the presently claimed invention.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

The invention claimed is:

1. A compression garment donning aid to assist a user with a compression garment, the compression garment donning aid comprising:

a pair of flexible sheets, each of the pair of flexible sheets having:

a sheet leg edge having a first sheet leg corner opposite a second sheet leg corner;

a mateable sheet leg fastener attached to the first sheet leg corner and the second sheet leg corner; and a sheet waist edge opposite the sheet leg edge, the sheet waist edge having a front sheet waist corner opposite a back sheet waist corner;

a sheet back fastener attached to the back sheet waist corner of one of the pair of flexible sheets and the back sheet waist corner of the other of the pair of flexible sheets; and a sheet front fastener attached to the front sheet waist corner of one of the pair of flexible sheets and the front sheet waist corner of the other of the pair of flexible sheets;

wherein at least one of the sheet back fastener and the sheet front fastener is openable.

2. The compression garment donning aid of claim 1 wherein the compression garment has a garment waist and garment leg hems, a length of each of the pair of flexible sheets between the sheet waist edge and the sheet leg edge being so dimensioned as to be greater than a length between the garment waist and the garment leg hems.

3. The compression garment donning aid of claim 1 wherein a length between the first sheet leg corner and the second sheet leg corner of each of the pair of flexible sheets is so dimensioned as to reach around a lower leg of the user.

4. The compression garment donning aid of claim 1 wherein a length of each of the sheet waist edges of the pair of flexible sheets is so dimensioned as to reach around a waist of the user.

5. The compression garment donning aid of claim 1 wherein at least one of the pair of flexible sheets defines a fabric cut out.

6. The compression garment donning aid of claim 1 wherein the mateable sheet leg fastener of each of the pair of flexible sheets is a hook and loop fastener.

7. The compression garment donning aid of claim 1 wherein at least one of the sheet back fastener and the sheet front fastener is a hook and loop fastener.

8. The compression garment donning aid of claim 1 wherein one of the sheet back fastener and the sheet front fastener is a fixed connection between the pair of flexible sheets.

9. The compression garment donning aid of claim 1 wherein at least one of the sheet back fastener and the sheet front fastener is elastic.

10. A compression garment kit for a user, the kit comprising:

a compression garment; and a compression garment donning aid;

wherein the compression garment donning aid comprises:

a pair of flexible sheets, each of the pair of flexible sheets having:

a sheet leg edge having a first sheet leg corner opposite a second sheet leg corner;

a mateable sheet leg fastener attached to the first sheet leg corner and the second sheet leg corner; and a sheet waist edge opposite the sheet leg edge, the sheet waist edge having a front sheet waist corner opposite a back sheet waist corner;

a sheet back fastener attached to the back sheet waist corner of one of the pair of flexible sheets and the back sheet waist corner of the other of the pair of flexible sheets; and a sheet front fastener attached to the front sheet waist corner of one of the pair of flexible sheets and the front sheet waist corner of the other of the pair of flexible sheets;

wherein at least one of the sheet back fastener and the sheet front fastener is openable.

11. The compression garment kit of claim 10 wherein the compression garment has a garment waist and garment leg hems, a length of each of the pair of flexible sheets between the sheet waist edge and the sheet leg edge being so dimensioned as to be greater than a length between the garment waist and the garment leg hems.

12. The compression garment kit of claim 10 wherein a length between the first sheet leg corner and the second sheet leg corner of each of the pair of flexible sheets is so dimensioned as to reach around a lower leg of the user.

13. The compression garment kit of claim 10 wherein the length of the sheet waist edge of the pair of flexible sheets is so dimensioned as to reach around a waist of the user.

14. The compression garment kit of claim 10 wherein at least one of the pair of flexible sheets defines a fabric cut out.

15. The compression garment kit of claim 10 wherein the mateable sheet leg fastener of each of the pair of flexible sheets is a hook and loop fastener.

16. The compression garment kit of claim 10 wherein at least one of the sheet back fastener and the sheet front fastener is a hook and loop fastener.

* * * * *